US011369172B2

(12) United States Patent
Tsao

(10) Patent No.: US 11,369,172 B2
(45) Date of Patent: Jun. 28, 2022

(54) COMBINED LUNCH BOX FOR COLD DRINK AND HOT FOOD

(71) Applicant: E-PACKAGE CREATION & SOLUTION MANUFACTURING CORP., Taipei (TW)

(72) Inventor: Chung-Piao Tsao, Taipei (TW)

(73) Assignee: E-PACKAGE CREATION & SOLUTION MANUFACTURING CORP., Taipei (TW)

( * ) Notice: Subject to any disclaimer, the term of this patent is extended or adjusted under 35 U.S.C. 154(b) by 356 days.

(21) Appl. No.: 16/747,509

(22) Filed: Jan. 20, 2020

(65) Prior Publication Data

US 2021/0219686 A1 Jul. 22, 2021

(51) Int. Cl.

| | |
|---|---|
| ***A45C 11/20*** | (2006.01) |
| ***B65D 5/42*** | (2006.01) |
| ***B65D 5/36*** | (2006.01) |
| ***B65D 5/52*** | (2006.01) |
| ***B65D 5/49*** | (2006.01) |

(52) U.S. Cl.

CPC ..... *A45C 11/20* (2013.01); *B65D 5/3607* (2013.01); *B65D 5/4266* (2013.01); *B65D 5/48046* (2013.01); *B65D 5/52* (2013.01)

(58) Field of Classification Search

CPC ..... B65D 5/3607; B65D 5/4266; B65D 5/48046; B65D 5/52; B65D 71/00; B65D 25/20; A45C 11/20

USPC ..... 229/120.36, 904, 117; 206/217, 194, 206/549, 218, 565; 220/737

See application file for complete search history.

(56) References Cited

U.S. PATENT DOCUMENTS

| | | | | |
|---|---|---|---|---|
| 1,507,078 | A * | 9/1924 | Mackie | A47F 5/114 5/280 |
| 3,640,380 | A * | 2/1972 | Huffman | A47J 47/14 229/117.14 |
| 4,491,220 | A * | 1/1985 | Daviss | B65D 5/42 206/217 |
| D305,304 | S * | 1/1990 | McCaleb | D9/751 |
| 6,360,944 | B1 * | 3/2002 | Gorman | A47G 23/0225 229/906 |
| 6,644,540 | B2 * | 11/2003 | Jamitzky | B65D 5/48014 229/117 |
| 9,010,074 | B2 * | 4/2015 | Lemke | B65D 5/5007 206/217 |
| 9,315,288 | B2 * | 4/2016 | Pinkstone | B65D 5/4204 |
| 9,676,510 | B2 * | 6/2017 | Learn | B65D 5/0254 |
| 10,045,645 | B2 * | 8/2018 | Kim | B65D 71/48 |

(Continued)

*Primary Examiner* — Christopher R Demeree
(74) *Attorney, Agent, or Firm* — Leong C. Lei

(57) ABSTRACT

A combined lunch box for cold drink and hot food includes a first piece, the two sides of which are respectively connected with a right piece, left piece, the top and bottom of which an annular sheet and first bottom piece, and the bottoms of the right piece and left piece a second bottom piece and third bottom piece; the bottom of a second piece is connected with a fourth bottom piece, the two sides of a third piece are respectively connected with the second piece and a fourth piece. Whereby, the present invention forms a three-dimensional container with a folding function after folded and bonded, where the annular sheet is used to accept a drink cup, and the container provides the accommodation of food, making it easy for users to carry, and greatly reduce the volume after the folding to facilitate stacking storage.

3 Claims, 8 Drawing Sheets

(56) References Cited

U.S. PATENT DOCUMENTS

| | | | | |
|---|---|---|---|---|
| 10,961,014 | B2 * | 3/2021 | Tart | B65D 5/3628 |
| 11,066,209 | B2 * | 7/2021 | Hengami | B65B 5/024 |
| 2003/0141355 | A1 * | 7/2003 | McLean, III | B65D 5/42 229/120.15 |
| 2007/0199835 | A1 * | 8/2007 | Cook | B65D 71/0022 206/217 |
| 2007/0295788 | A1 * | 12/2007 | Hurtado | B65D 71/72 229/120.14 |
| 2011/0180593 | A1 * | 7/2011 | Wettlaufer | B65D 25/20 229/189 |

* cited by examiner

COMBINED LUNCH BOX FOR COLD DRINK AND HOT FOOD

(a) TECHNICAL FIELD OF THE INVENTION

The present invention relates to a simple multifunctional structure for accepting drink and food, and more particularly to a structure for simultaneously accepting a cup of drink and food which can be held by one hand.

(b) DESCRIPTION OF THE PRIOR ART

With the increasing awareness of environmental protection, the use of carton boxes to hold food or articles has been widely adopted and valued by modern people, and in particular, it is possible to use recycled paper to make carton boxes, thereby repeatedly using paper sources and preventing waste pollution from being caused due to the use of polyurethane blocks, plastics or other non-recyclable materials.

The conventional carton box structure has only one single use, for example, the use of holding food or articles only with a cartoon box. However, if customers hold a container for drink with one hand and a cartoon box for food with another hand, it is very inconvenient for them. Therefore, to allow a food cartoon box or drink container to be conveniently carried, merchants will use plastic bags to hold these beverage containers or food cartons such that plastic bags are heavily used, which causes relatively increased pollution to the environment.

SUMMARY OF THE INVENTION

To overcome the above disadvantages, the present invention proposes a combined lunch box for cold drink and hot food, including a first piece, the two sides of which are respectively connected with a right piece, left piece, the top and bottom of which an annular sheet and first bottom piece, and the bottoms of the right piece and left piece a second bottom piece and third bottom piece; the bottom of a second piece is connected with a fourth bottom piece, the two sides of a third piece are respectively connected with the second piece and a fourth piece. Whereby, the present invention forms a three-dimensional container with a folding function after folded and bonded, where the annular sheet is used to accept a drink cup, and the container provides the accommodation of food, making it easy for users to carry, and greatly reduce the volume after the folding to facilitate stacking storage.

DETAILED DESCRIPTION OF THE PREFERRED EMBODIMENTS

Figure 1:
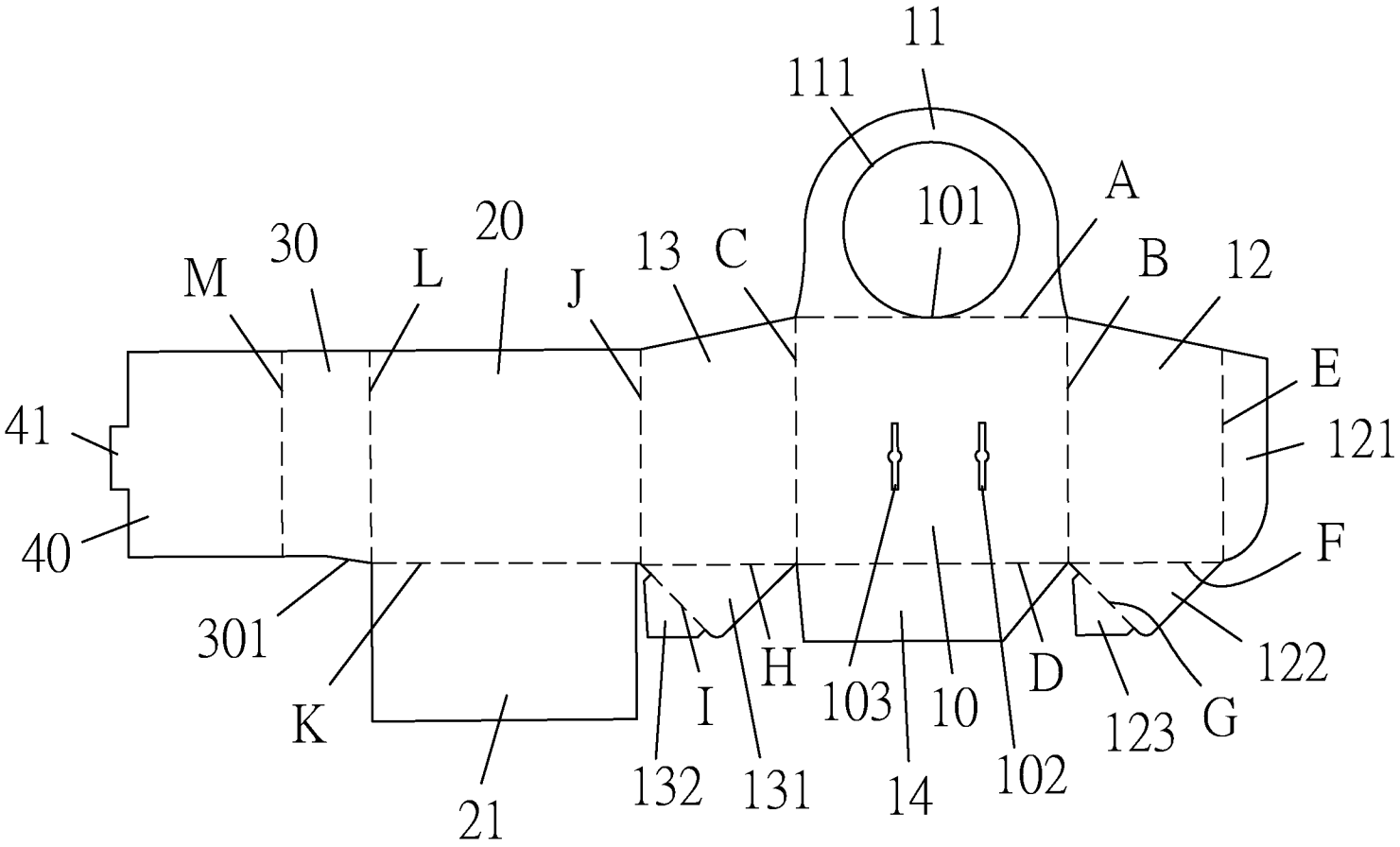
FIG. 1 is a plan view of the present invention when expanded.

Referring to FIG. 1, a combined lunch box for cold drink and hot food of the present invention includes a first piece 10, annular sheet 11, right piece 12, left piece 13, first bottom piece 14, second bottom piece 122, third bottom piece 131, second piece 20, fourth bottom piece 21, third piece 30 and fourth piece 40.

The top face of the first piece 10 has a first concave arc portion 101, and the top of the first piece 10 is in connection with the annular piece 11, the inside of which has a second concave arc portion 111, which is connected correspondingly to the first concave arc 101 to form a circular hole. Furthermore, a first fold line A is formed between the first piece 10 and annular piece 11, and a first inserting hole 102 and second inserting hole 103 are distantly configured on the first piece 10.

The right, left and bottom sides of the first piece 10 are respectively connected with the right piece 12, left piece 13 and first bottom piece 14, where a second fold line B, third fold line C and fourth fold line D are respectively formed between the first piece 10 and right piece 12, between the first piece 10 and left piece 13, and between the first piece 10 and first bottom piece 14.

The top of the first bottom piece 14 is larger than the bottom thereof in length, allowing the two sides of the first bottom piece 14 to be inclined.

The right side and bottom of the right piece 12 are respectively connected with a first adhesive portion 121 and the second bottom piece 122, where a fifth fold line E is formed between the right piece 12 and first adhesive portion 121, and a sixth fold line F the right piece 12 and second bottom piece 122.

Figure 2:
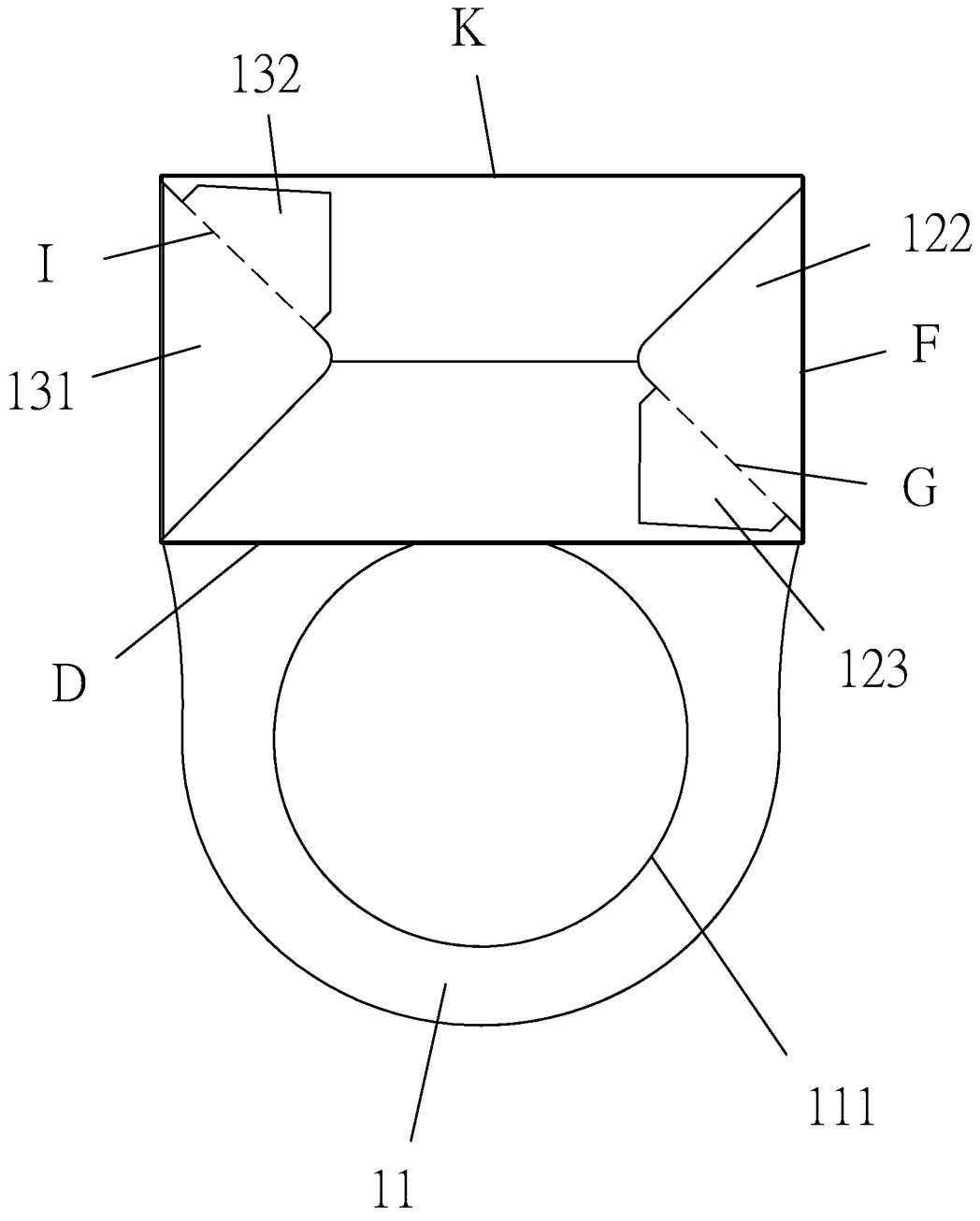
FIG. 2 is a schematic view of the present invention after assembly.

Referring to FIGS. 1 and 2, the second bottom piece 122 is a triangular body, and one side of the second bottom piece 122 facing the first bottom piece 14 is connected with a second adhesive portion 123; a seventh fold line G is formed between the second bottom piece 122 and second adhesive portion 123; and the second adhesive portion 123 is used to be in combination with the first bottom piece 14.

The bottom of the left piece 13 is connected with the third bottom piece 131, and an eighth fold line H is formed between the left piece 13 and third bottom piece 131, where the third bottom piece 131 is a triangular body, the left side of which is connected with a third adhesive portion 132. Furthermore, a ninth fold line I is formed between the third bottom piece 131 and third adhesive portion 132.

The bottoms of the left piece 12, first piece 10 and left piece 13 are of equal length and flushed with each other, allowing the sixth fold line F, fourth fold line D and eighth fold line H are positioned on the same level.

Figure 3:
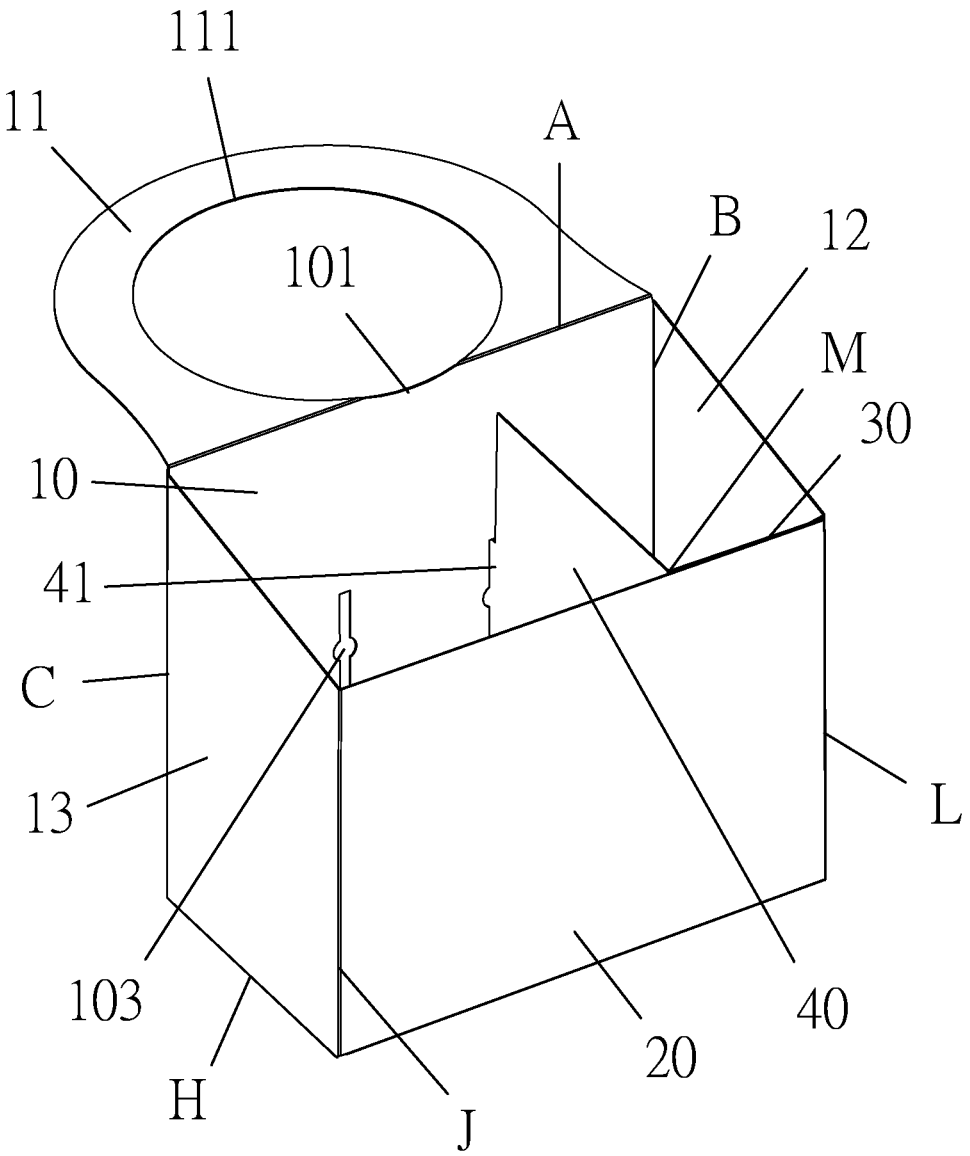
FIGS. 3 and 4 respectively are a perspective view of the present invention.

Referring to FIG. 1 again, the present invention further has the second piece 20, the right side of which is in connection with the left piece 13, where a tenth fold line J is formed between the second piece 20 and left piece 13. Referring to FIG. 3, the second piece 20 is opposite to the first piece 10 after the second piece 20 is folded along the tenth fold line J. Furthermore, the bottom of the second piece 20 is in connection with the fourth bottom piece 21, and an eleventh fold line K is formed between the second piece 20 and fourth bottom piece 21; the third adhesive portion 132 faces the right side of the fourth bottom piece 21 and is used to combine with the fourth bottom piece 21.

The right side of the third piece 30 is in connection with the left side of the second piece 20, a twelfth fold line L is formed between the third piece 30 and second piece 20, and the bottom of the third bottom piece 30 has an inclined side 301, allowing the length of the right side of the third piece 30 to be larger than the one of the left side thereof.

The present invention further has the fourth piece 40, the right side of which is in connection with the left side of the third piece 30, and a thirteenth fold line M is formed between the fourth piece 40 and third piece 30. Furthermore, an insert 41 is protruded from the left side of the fourth piece 40.

Figure 4:
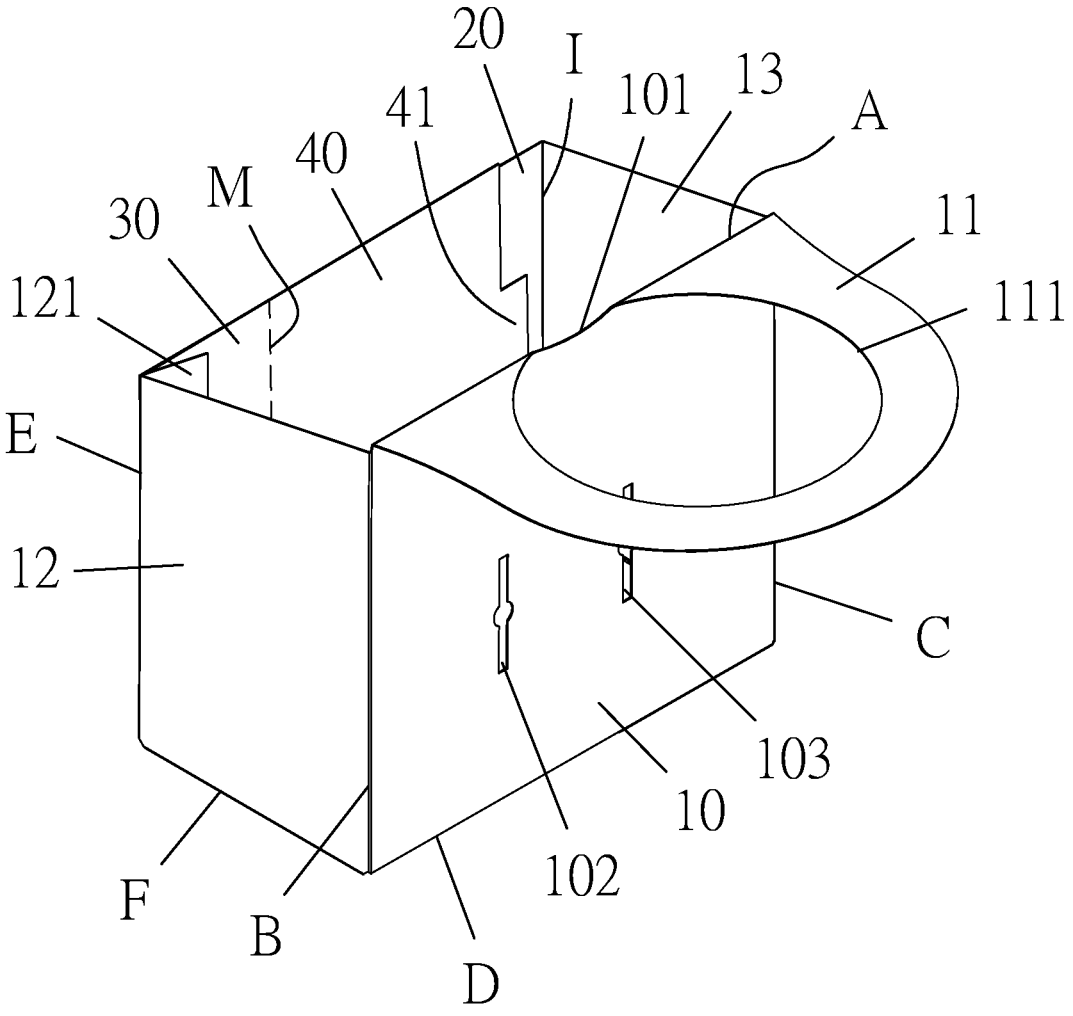

Referring to FIGS. 1 and 4, the third piece 30 is folded along the twelfth fold line L, allowing the third piece 30 and fourth piece 40 to be stacked with the second piece 20 and opposite to the first piece 10; the first adhesive portion 121 is in combination with the third piece 30, and the fourth piece 40 is stacked with the first bottom piece 14, second bottom piece 122 and third bottom piece 131, forming a three-dimensional container, where the insert 41 is adapted to insert in the first inserting hole 102 or third inserting hole 103 to partition the interior space of the container.

Figure 5:
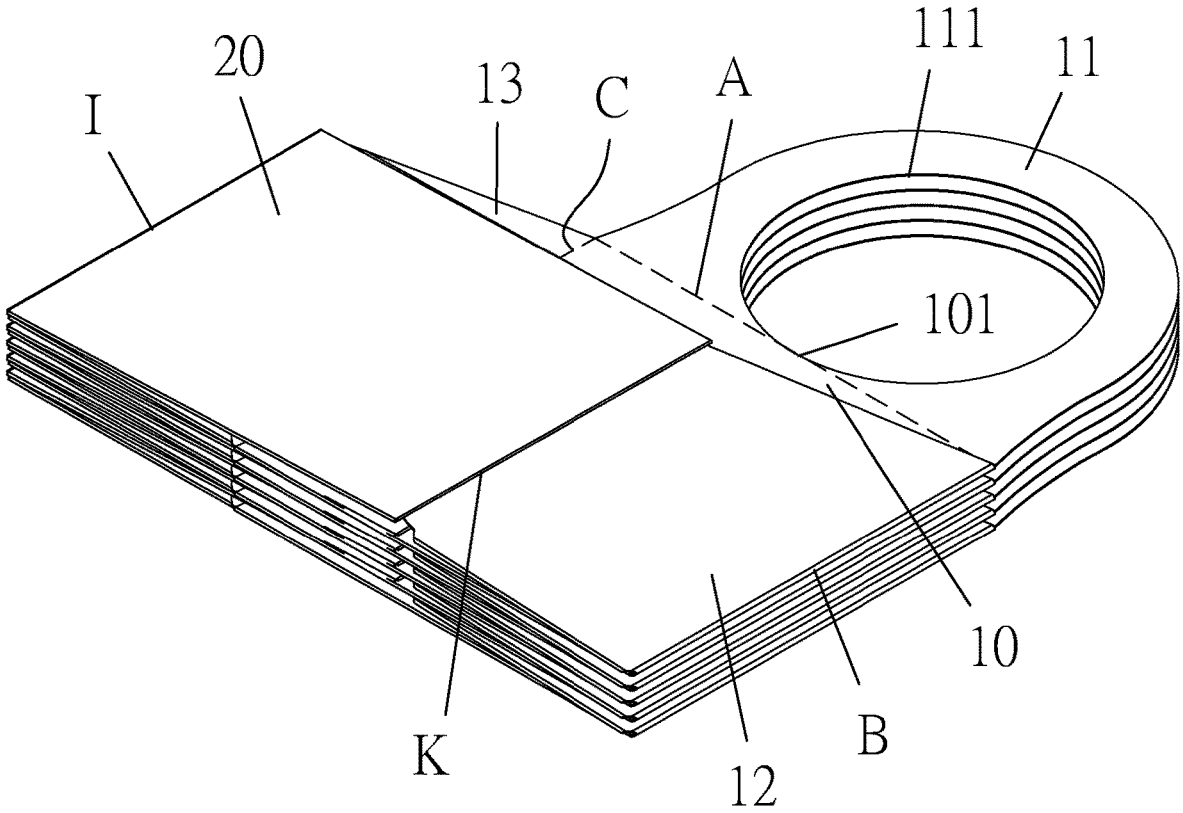
FIG. 5 is a perspective view of the present invention after stacking storage.

Referring to FIG. 5, the present invention can be folded into a flat body to reduce the volume, thereby facilitating stacking storage. In addition, it can be produced automatically without manual time-consuming folding.

Figure 6:
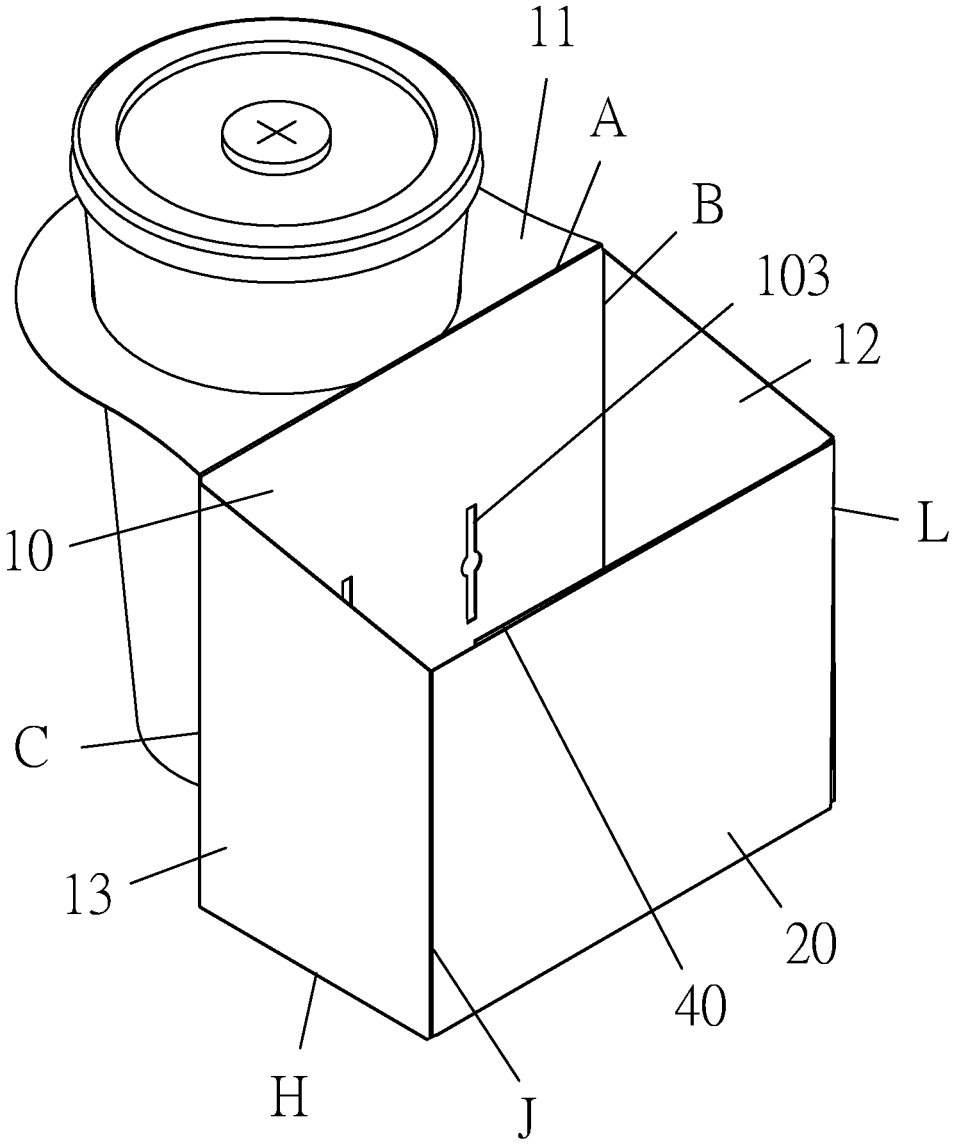
FIGS. 6, 7 and 8 respectively are a schematically perspective view of the present invention in a use state.
Figure 7:
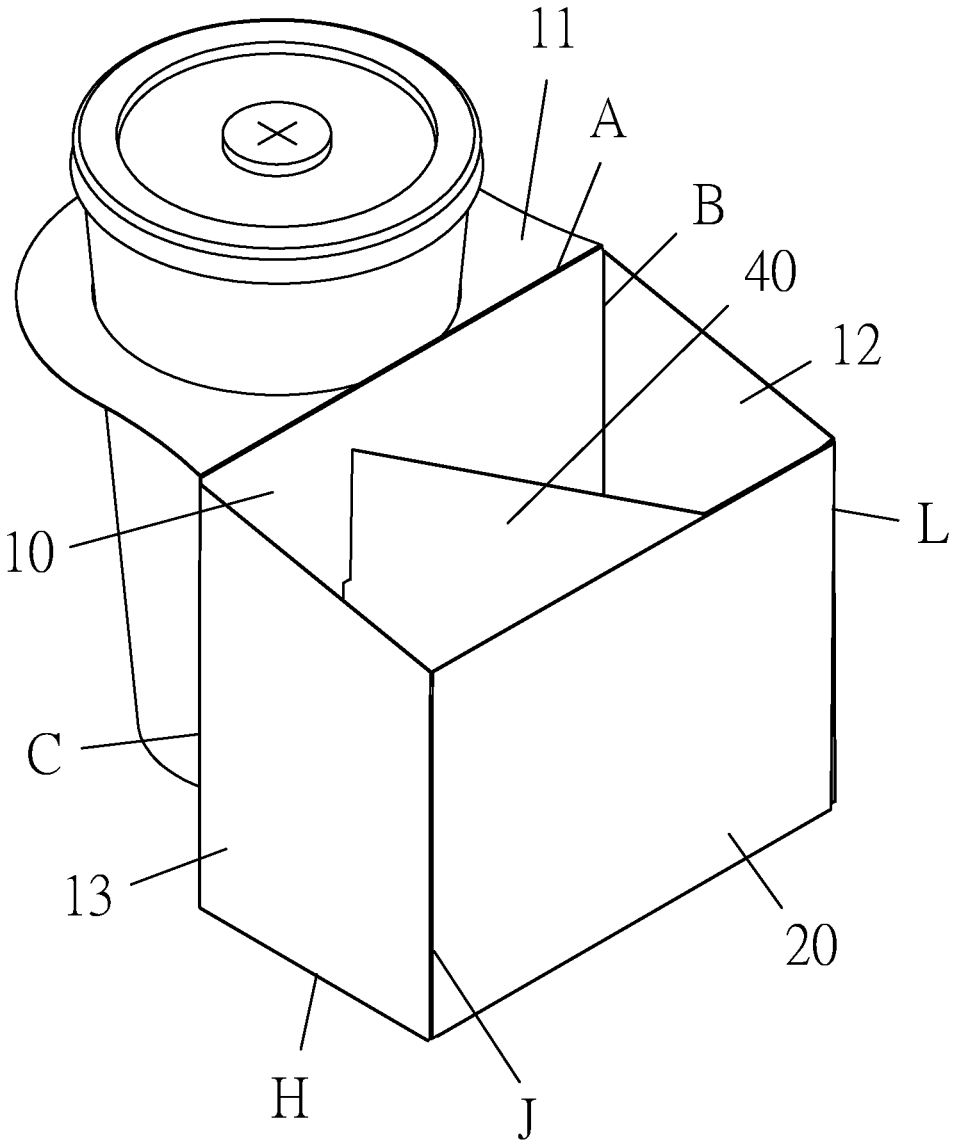
Figure 8:
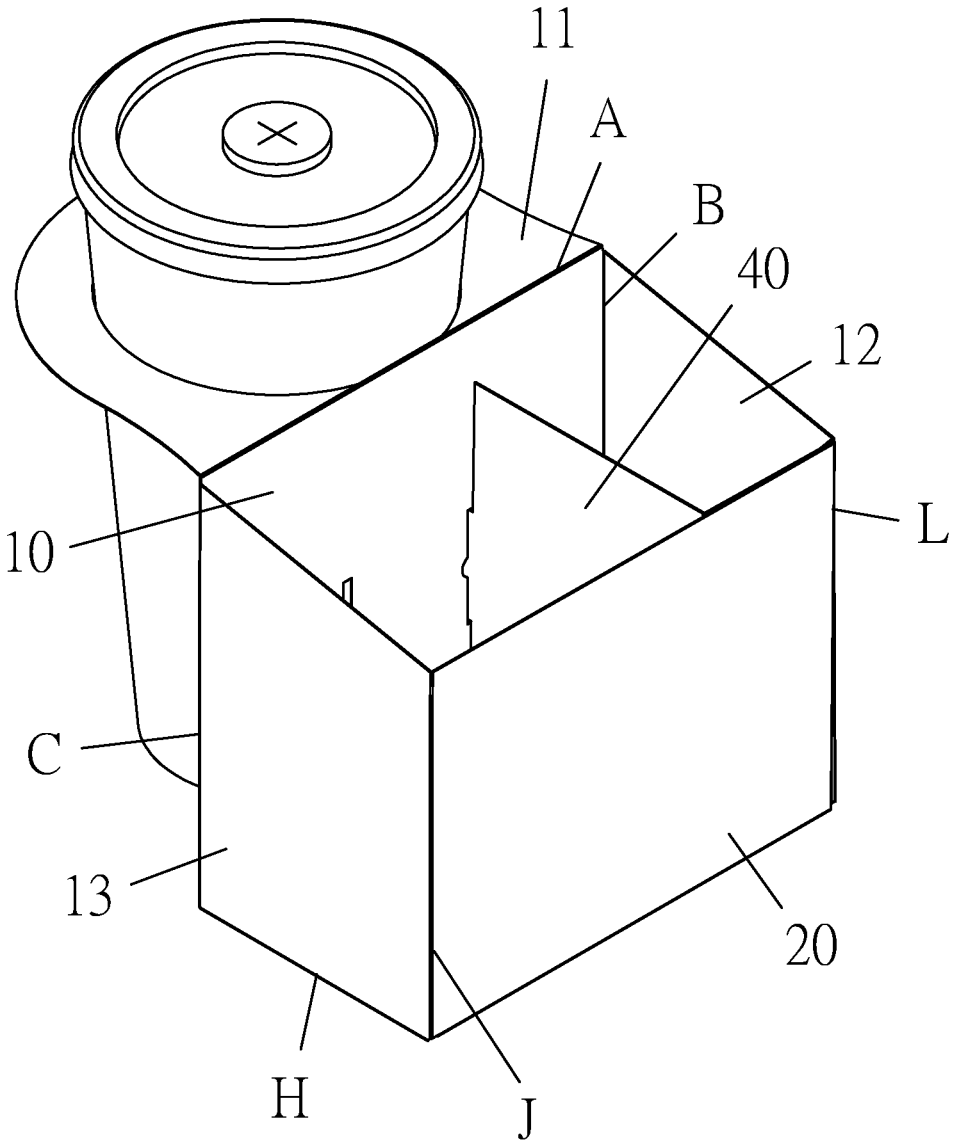

Referring to FIGS. 6 to 8, which show the present invention in a use state, the first concave arc portion 101 is connected correspondingly to the second concave arc portion 111 to form a circular hole adapted to accommodate a cup; a user may not use the insert 41 or may insert the insert 41 in the first inserting hole 102 or inserting hole 103 according to requirements; if the insert 41 is not used, the container space can accommodate larger food; if the insert 41 is used to partition the container space, two kinds of food can be accommodated, or one of the partitioned spaces can be used to accommodate food and another one is used to collect food residues and bones because the insert 41 is obliquely configured.

I claim:

1. A combined lunch box for cold drink and hot food, comprising a first piece, annular sheet, right piece, left piece, first bottom piece, second bottom piece, third bottom piece, second piece, fourth bottom piece, third piece and fourth piece, wherein a top face of said first piece has a first concave arc portion, a top of said first piece is in connection with an annular sheet, an inside of said annular sheet has a second concave arc portion, said first concave arc portion is connected correspondingly to said second concave arc portion to form a circular hole, a first fold line is formed between said first piece and annular sheet, and said first piece is distantly configured with a first inserting hole and second inserting hole;

a right side, left side and bottom of said first piece are respectively connected with said right piece, left piece and first bottom piece, a second fold line, third fold line and fourth fold line are respectively formed between said first piece and right piece, between said first piece and left piece, and between said first piece and first bottom piece;

a top of said first bottom piece is larger than a bottom thereof in length, allowing two sides of said first bottom piece to be inclined;

a right side and bottom of said right piece are respectively connected with a first adhesive portion and second bottom piece, a fifth fold line is formed between said right piece and first adhesive portion, and a sixth fold line between said right piece and second bottom piece;

said second bottom piece is a triangular body, one side of said second bottom piece facing said first bottom piece is connected with a second adhesive portion, a seventh fold line is formed between said second bottom piece and second adhesive portion, and said second adhesive portion is used to be in combination with said first bottom piece;

a bottom of said left piece is in connection with said third bottom piece, an eighth fold line is formed between said left piece and third bottom piece, said third bottom piece is a triangular body, a left side thereof is in connection with a third adhesive portion, and a ninth fold line is formed between said third bottom piece and third adhesive portion;

a left side of said second piece is in connection with said left piece, a tenth fold line is formed between said second piece and left piece, said second piece is opposite to said first body after said second piece is folded along said tenth fold line, a bottom of said second piece is in connection with said fourth bottom piece, an eleventh fold line is formed between said second piece and fourth bottom piece, said third adhesive faces a right side of said fourth bottom piece, and said third adhesive portion is used to be in combination with said fourth bottom piece;

a right side of said third piece is in connection with a left side of said second piece, and a twelfth fold line is formed between said third piece and second piece; and a right side of said fourth piece is in connection with a left side of said third piece, a thirteenth fold line is formed between said fourth piece and third piece, a left side of said fourth piece is protruded with an insert, said third piece is folded along said twelfth fold line, allowing said third piece and fourth piece to be stacked with said second piece and opposite to said first piece, said first adhesive portion is in combination with said third piece along said twelfth fold line, said fourth bottom piece is stacked with said first bottom piece, second bottom piece and third bottom piece, forming a three-dimensional container, said insert is used to insert in said first inserting hole or second inserting hole to partition an interior space of said container.

2. The combined lunch box according to claim 1, wherein a bottom of said third piece is inclined, allowing a right side of said third piece to be larger than a left side thereof in length.

3. The combined lunch box according to claim 1, wherein bottoms of said right piece, first piece and left piece are of equal length and flushed with one another, allowing said sixth fold line, fourth fold line and eighth fold line to be on the same level.

* * * * *